US009486854B2

(12) United States Patent
Propheter-Hinckley

(10) Patent No.: US 9,486,854 B2
(45) Date of Patent: Nov. 8, 2016

(54) CERAMIC AND REFRACTORY METAL CORE ASSEMBLY

(75) Inventor: Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 1091 days.

(21) Appl. No.: 13/608,210

(22) Filed: Sep. 10, 2012

(65) Prior Publication Data

US 2014/0072447 A1 Mar. 13, 2014

(51) Int. Cl.

| | |
|---|---|
| ***B22C 9/10*** | (2006.01) |
| ***B22D 23/00*** | (2006.01) |
| ***F01D 25/12*** | (2006.01) |
| ***B22C 9/04*** | (2006.01) |
| ***F01D 5/18*** | (2006.01) |

(52) U.S. Cl.

CPC ..... *B22C 9/103* (2013.01); *B22C 9/04* (2013.01); *B22D 23/00* (2013.01); *F01D 5/186* (2013.01); *F01D 25/12* (2013.01); *F05D 2230/21* (2013.01); *F05D 2230/211* (2013.01); *F05D 2300/13* (2013.01)

(58) Field of Classification Search

CPC ..... B22C 9/10; B22C 9/103
USPC ..... 164/369
See application file for complete search history.

(56) References Cited

U.S. PATENT DOCUMENTS

| | | | | |
|---|---|---|---|---|
| 6,929,054 | B2 * | 8/2005 | Beals et al. | B22C 7/02 164/365 |
| 7,270,170 | B2 | 9/2007 | Beals et al. | |
| 7,364,405 | B2 | 4/2008 | Cunha et al. | |
| 7,731,481 | B2 | 6/2010 | Cunha et al. | |
| 7,744,347 | B2 | 6/2010 | Cunha et al. | |
| 8,109,725 | B2 | 2/2012 | Abdel-Messeh et al. | |
| 8,157,527 | B2 | 4/2012 | Piggush et al. | |

(Continued)

FOREIGN PATENT DOCUMENTS

| | | |
|---|---|---|
| EP | 2193132 A | 7/1986 |
| EP | 1543896 A2 | 6/2005 |

(Continued)

OTHER PUBLICATIONS

The International Search Report mailed Aug. 27, 2013 for International Application No. PCT/US2013/043628.
Extended European Search Report for EP Application No. 13835530.0, dated May 14, 2016, 10 pages.

*Primary Examiner* — Kevin P Kerns
(74) *Attorney, Agent, or Firm* — Kinney & Lange, P.A.

(57) ABSTRACT

A core assembly for forming a cast component includes a refractory metal core and a ceramic core element. The refractory metal core includes first and second ends and sides extending from the first end to the second end. The ceramic core element includes a slot positioned between first and second lands, each land having an inner surface facing the slot and an adjacent outer surface. The first end of the refractory metal core is secured within the slot with an adhesive, and the refractory metal core extends from the ceramic core element in both a longitudinal and a transverse direction. The slot, lands, and refractory metal core form a core assembly providing access paths to the sides of the refractory metal core. Surplus adhesive is removed from the refractory metal core via the access paths. Investment casting provides the component with an internal passage and an internal cooling circuit.

13 Claims, 9 Drawing Sheets

(56) References Cited

U.S. PATENT DOCUMENTS

| | | | | |
|---|---|---|---|---|
| 8,251,123 | B2 * | 8/2012 | Farris et al. | B22C 9/108 164/28 |
| 2006/0086478 | A1 | 4/2006 | Persky et al. | |
| 2009/0056902 | A1 | 3/2009 | Dodds et al. | |
| 2010/0003142 | A1 | 1/2010 | Piggush et al. | |
| 2010/0129195 | A1 | 5/2010 | Surace et al. | |
| 2010/0206512 | A1 | 8/2010 | Dube et al. | |
| 2012/0168108 | A1 | 7/2012 | Farris et al. | |

FOREIGN PATENT DOCUMENTS

| | | |
|---|---|---|
| EP | 1652601 A2 | 5/2006 |
| EP | 2471613 A2 | 7/2012 |
| EP | 2532457 A2 | 12/2012 |
| EP | 2554294 A2 | 2/2013 |
| GB | 2050890 A | 1/1981 |

* cited by examiner

CERAMIC AND REFRACTORY METAL CORE ASSEMBLY

STATEMENT OF GOVERNMENT INTEREST

This invention was made with government support under Contract No. N00019-02-C-3003 awarded by the United States Navy. The government has certain rights in the invention.

BACKGROUND

Turbine engine components, such as turbine blades and vanes, are operated in high temperature environments. To avoid deterioration in the components resulting from their exposure to high temperatures, it is necessary to provide cooling circuits within the components. Turbine blades and vanes are subjected to high thermal loads on both the suction and pressure sides of their airfoil portions and at both the leading and trailing edges. The regions of the airfoils having the highest thermal load can differ depending on engine design and specific operating conditions.

Refractory metal core technology offers the potential to provide higher specific cooling passages for turbine components such as blade and vane airfoils and seals. Refractory metal core technology allows cooling circuits to be placed just under the surface of the airfoil through which cooling air flows and is expelled into the gaspath. However, state of the art cooling circuits made using refractory metal cores can contain artifacts in the event of incomplete removal of adhesive material prior to casting. These defects and artifacts can reduce the cooling effectiveness provided by the cooling circuits and compromise the strength of the component.

SUMMARY

A method for casting a component includes forming a refractory metal core, forming a ceramic core element, securing a first end of the refractory metal core into a slot of the ceramic core with an adhesive to form a core assembly, removing surplus adhesive from the refractory metal core and investment casting the airfoil using the core assembly. The refractory metal core includes first and second ends and first and second sides, each side extending from the first end to the second end. The ceramic core element includes an upstream end, a downstream end, a first side extending from the upstream end to the downstream end, a second side extending from the upstream end to the downstream end and generally opposite the first and a slot positioned between a first land and a second land for receiving the first end of the refractory metal core. Each land includes an inner surface facing the slot and an outer surface adjacent the inner surface. The refractory metal core extends from the ceramic core element in both a longitudinal and a transverse direction. The slot and the first and second lands of the ceramic core element and the first end and the first and second sides of the refractory metal core form a core assembly that provides access paths to the first and second sides of the refractory metal core near the first end. Surplus adhesive is removed from the first and second sides of the refractory metal core near the first end of the refractory metal core with a tool via the access paths. Investment casting provides the component with an internal core passage and an internal cooling circuit.

A core assembly includes a ceramic core element, a refractory metal core and an adhesive. The ceramic core element includes an upstream end, a downstream end, a first side extending from the upstream end to the downstream end, a second side extending from the upstream end to the downstream end and generally opposite the first and a slot formed between a first land and a second land. Each land has an inner surface facing the slot and an outer surface adjacent the inner surface. The refractory metal core includes first and second ends, a first side extending from the first end to the second end and a second side extending from the first end to the second end. The refractory metal core extends from the ceramic core element in both a longitudinal and a transverse direction. The first end is secured within the slot of the ceramic core element with the adhesive so that the first side of the refractory metal core and the first land form a first access path to the adhesive and the second side of the refractory metal core and the second land form a second access path to the adhesive. The first and second access paths allow adhesive removal from the first and second sides of the refractory metal core.

A cast component includes a leading edge surface, a trailing edge surface, a pressure side surface extending from the leading edge surface to the trailing edge surface, a suction side surface extending from the leading edge surface to the trailing edge surface generally opposite the pressure side surface, a first feed cavity, a second feed cavity, a rib separating the first and second feed cavities and a cooling passage. The first feed cavity is located between the leading edge and trailing edge surfaces and between the pressure side and suction side surfaces and bounded by a first cavity wall. The second feed cavity is located between the first feed cavity and the trailing edge surface and between the pressure side and suction side surfaces and bounded by a second cavity wall. The cooling passage is in communication with the first feed cavity and extends between the second feed cavity and either the pressure side surface or the suction side surface.

DETAILED DESCRIPTION

Cooling circuits for components such as airfoils can be prepared by investment casting using refractory metal cores. Prior to casting, the refractory metal cores are secured to ceramic core elements with an adhesive to form a core assembly. As described herein, the refractory metal cores are arranged within the core assembly to provide access to both sides of the refractory metal cores so that surplus adhesive can be more easily removed.

Investment casting is one technique used to create hollow components such as blades and vanes for gas turbine engines. In some investment casting methods, ceramic core elements are used to form the inner passages of blade and vane airfoils and platforms. Refractory metal cores (RMCs) can be used to form internal cooling circuits that receive cooling fluid from the inner passages formed by the ceramic core elements. In one investment casting method, a ceramic feed core and an RMC are separately formed. The RMC is then secured to the ceramic feed core, typically using a ceramic adhesive or glue. A wax pattern is formed over the RMC and ceramic feed core, cores or core assembly. A ceramic shell is then formed over the wax pattern and the wax pattern is removed from the shell. Molten metal is introduced into the ceramic shell. The molten metal, upon cooling, solidifies and forms the walls of the airfoil and/or platform. The ceramic feed core can form inner passages within the airfoil and/or platform and the RMC can define an internal cooling circuit. The ceramic shell is removed from the cast part. Thereafter, the ceramic feed core and the RMC are removed, typically chemically, using a suitable removal technique. Removal of the RMC leaves a cooling circuit within the wall of the airfoil and/or platform.

Figure 1:
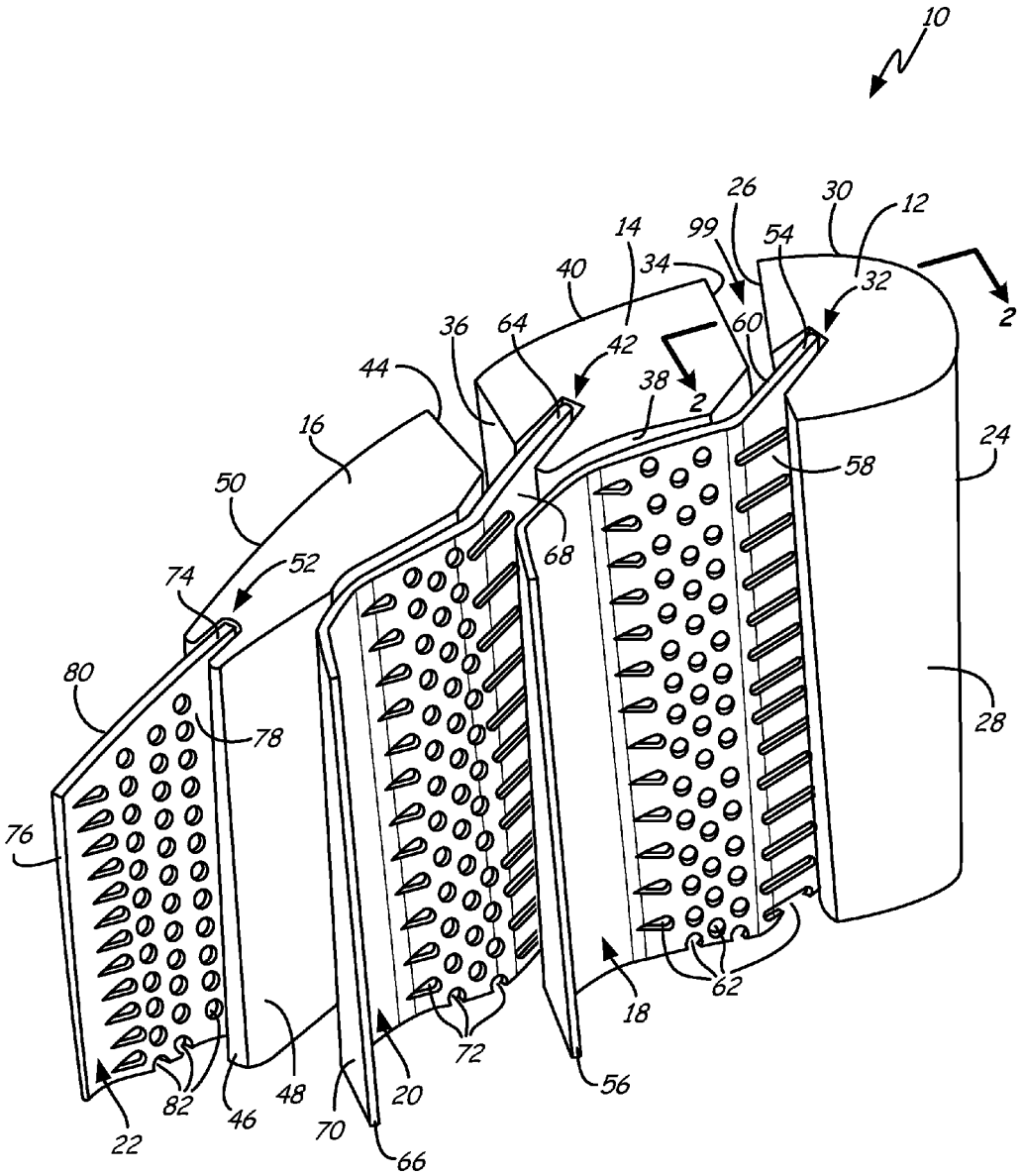
FIG. 1 is a perspective view of one embodiment of a core assembly that allows access to both sides of the refractory metal core to facilitate adhesive removal.

FIG. 1 illustrates a perspective view of one embodiment of a core assembly for forming an airfoil that allows access to both sides of the RMC for adhesive removal. Core assembly 10 includes leading edge ceramic core 12, midchord ceramic core 14, trailing edge ceramic core 16, upstream RMC 18, downstream RMC 20 and trailing edge RMC 22. Leading edge ceramic core 12, midchord ceramic core 14 and trailing edge ceramic core 16 are used to form inner passages (feed cavities) for cooling fluid within the airfoil. Upstream RMC 18, downstream RMC 20 and trailing edge RMC 22 are used to form cooling circuits (a network of cooling passages) within the walls of the airfoil. The cooling circuits in the cast airfoil will receive cooling fluid from the inner passage(s) with which they are connected. For example, in the embodiment shown in FIG. 1, the cooling circuit formed by upstream RMC 18 will receive cooling fluid from the inner passage formed by leading edge ceramic core 12. In order for the cooling circuits in the cast airfoil to receive cooling fluid from the inner passage, the ceramic core and the RMC are in contact with one another. Refractory metal cores 18, 20 and 22 are secured to the appropriate ceramic core to maintain contact during the casting process. In some embodiments, core assembly 10 can contain more than one midchord ceramic core 14 and associated downstream RMCs 20.

During casting, ceramic cores 12, 14 and 16 form inner passages within the airfoil that travel in a generally spanwise direction (e.g., radially through a central region of the airfoil). Leading edge ceramic core 12 includes upstream surface 24, downstream surface 26, pressure side surface 28 and suction side surface 30. As shown in FIG. 1, slot 32 is formed along downstream surface 26. Midchord ceramic core 14 includes upstream surface 34, downstream surface 36, pressure side surface 38 and suction side surface 40. Slot 42 is formed along downstream surface 36. Trailing edge ceramic core 16 includes upstream surface 44, downstream surface 46, pressure side surface 48 and suction side surface 50. Slot 52 is formed along downstream surface 46. Slots 32, 42 and 52 can extend the full span length of ceramic cores 12, 14 and 16, respectively, or only a portion of the full length of the ceramic cores.

Upstream RMC 18 includes first end 54, second end 56, first side 58 and second side 60. As shown in FIG. 1, first end 54 is positioned within slot 32. First end 54 of RMC 18 is held in place within slot 32 with a ceramic adhesive or glue (not shown in FIG. 1). The ceramic adhesive can be applied to the RMC prior to or after insertion into the ceramic core slot by various suitable means. The ceramic adhesive secures first end 54 within slot 32 so that RMC 18 is in contact with slot 32 and the internal cooling circuit formed in the cast airfoil communicates with the formed inner passage. The ceramic adhesive generally completely fills the slots within the ceramic cores.

Upstream RMC 18 also includes a plurality of openings 62. Once cast, openings 62 form a plurality of pedestals or other features that direct cooling fluid through the cooling circuit. Openings 62 can be circular, oblong, racetrack-shaped, teardrop-shaped or any other shape depending on the flow control needs of the cooling circuit. Upstream RMC 18 has a spanwise length appropriate for the length of slot 32. Upstream RMC 18 can be straight between first end 54 and second end 56. Alternatively, upstream RMC 18 can include one or more bends between ends 54 and 56 as shown in FIG. 1. Downstream RMC 20 includes first end 64, second end 66, first side 68, second side 70 and openings 72. Trailing edge RMC 22 includes first end 74, second end 76, first side 78, second side 80 and openings 82. The above description of upstream RMC 18 also applies to downstream RMC 20 and trailing edge RMC 22.

In the illustrated embodiment, one notable difference between trailing edge RMC 22 and both upstream RMC 18 and downstream RMC 20 is that trailing edge RMC 22 is received by slot 52 along downstream surface 46 of trailing edge ceramic core 16, while upstream RMC 18 and downstream RMC 20 can be received in slots along the downstream surface of ceramic cores 12 and 14, respectively, or along the pressure or suction side surfaces of ceramic cores 12 and 14. Trailing edge ceramic core 16 is typically easier to cast and maintain control over wall thicknesses than ceramic cores 12 and 14. Casting ceramic cores 12 and 14 is more difficult due to the angles at which upstream RMC 18 and downstream RMC 20 are secured to ceramic cores 12 and 14, respectively. Additionally, second side 60 of RMC 18 and second side 70 of RMC 20 are adjacent to additional ceramic cores (ceramic cores 14 and 16, respectively) and cannot be positioned through the wax wall of the suction surface side as RMC 22 can. As described below in greater detail, RMCs 18 and 20 also extend in both a longitudinal and a transverse direction.

The ceramic adhesive used to secure the RMCs to the ceramic cores can migrate and wick along the RMC, traveling to a downstream region of the RMC outside of the slot on the ceramic core. This surplus adhesive can create undesired artifacts in the cast component, such as inclusions and fins, which can reduce the cooling effectiveness of the internal cooling circuits formed by the RMCs or impact the strength of the component. To avoid the formation of these unwanted artifacts, excess ceramic adhesive should be removed prior to forming the wax pattern. A tool was developed and is typically used to remove surplus adhesive. The tool can remove surplus adhesive along the regions of the RMCs that the tool can access. Certain configurations of RMCs and ceramic cores prevent access to one side of the RMC where the ceramic adhesive can wick, however. In these configurations, the ceramic adhesive is more difficult to remove from one side of the RMC (e.g., the side of the RMC adjacent to the ceramic core). The embodiments described herein provide configurations that allow adhesive removal from both sides of the RMC.

Figure 2A:
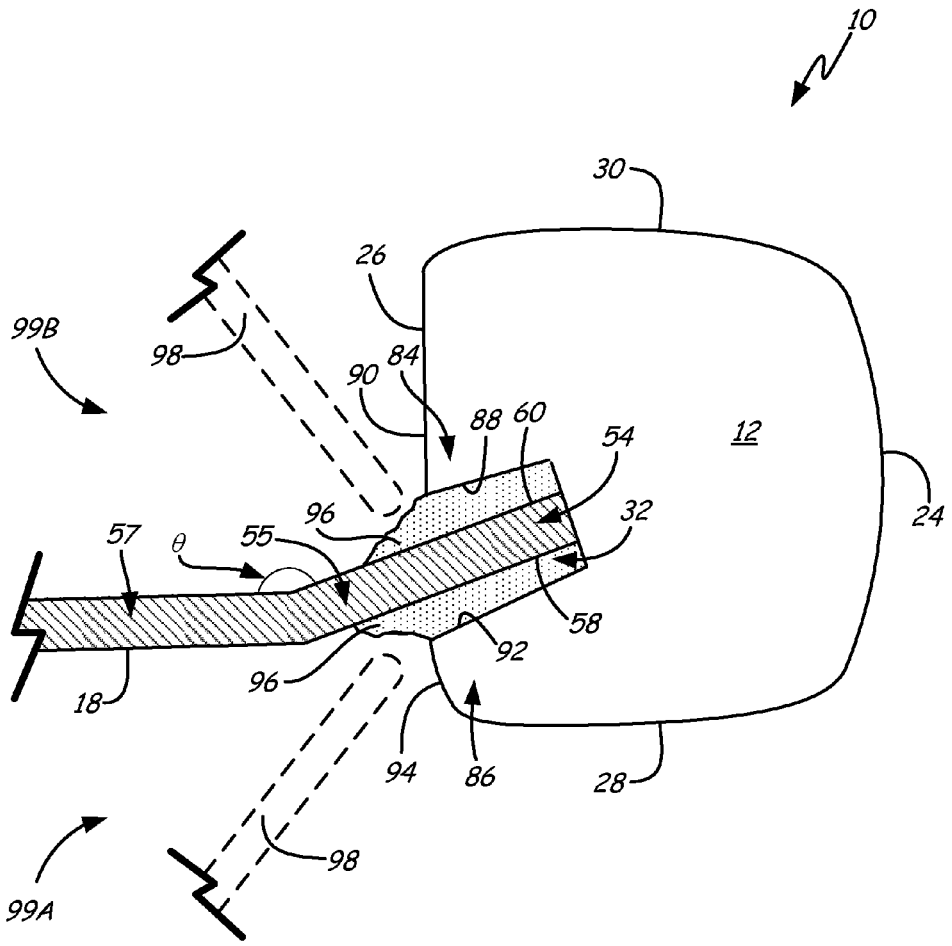
FIG. 2A is a partial cross section view of the core assembly shown in FIG. 1 taken along the line 2-2.

FIG. 2A illustrates a cross section view of leading edge ceramic core 12 and upstream RMC 18 shown in FIG. 1 taken along the line 2-2. Slot 32 is located between two lands, first land 84 and second land 86, positioned along the downstream portion of leading edge ceramic core 12. Each land 84 and 86 includes an inner surface facing slot 32 and an outer surface that is adjacent the inner surface and does not face slot 32. First land 84 includes inner surface 88 and outer surface 90, while second land 86 includes inner surface 92 and outer surface 94. First land 84 is the region between inner surface 88 and outer surface 90, and second land 86 is the region between inner surface 92 and outer surface 94. FIG. 2A also illustrates ceramic adhesive 96, used to secure upstream RMC 18 within slot 32.

As shown in FIG. 2A, upstream RMC 18 includes first section 55 and second section 57. First section 55 is located proximate to first end 54 of RMC 18 and a portion of first section 55 is located within slot 32. Second section 57 is located between first section 55 and second end 56 of RMC 18. Second section 57 is angled with respect to first section 55 as illustrated in FIG. 2A. Angle θ represents the angle formed between first section 55 and second section 57. In some embodiments, angle θ is at least about 90°. Upstream RMC 18 can contain more than two sections angled relative to one another. As shown in FIG. 1, upstream RMC contains four different sections, each section angled relative to the adjacent section(s) as shown by the bends in RMC 18. This configuration provides an RMC that extends from a ceramic core in both a longitudinal direction (i.e. upstream or downstream) and a transverse direction (i.e. laterally away from the camber line of the cast airfoil). The above description of leading edge ceramic core 12 and upstream RMC 18 also applies to midchord ceramic core 14 and downstream RMC 20.

As shown in FIG. 2A, ceramic adhesive 96 has flowed out of slot 32 and along first and second sides 58 and 60 of upstream RMC 18. Ceramic adhesive 96 outside of slot 32 can create the unwanted artifacts in the resulting cast component as described above. FIG. 2A also illustrates tool 98 (dashed line) that can be used to remove surplus ceramic adhesive 96 that has flowed out of slot 32 along the sides of upstream RMC 18. Tool 98 can be used to remove ceramic adhesive 96 on both first side 58 and second side 60 of upstream RMC 18 as shown. Some configurations do not allow tool 98 to be used on both sides of the RMC due to spatial constraints. Here, however, tool 98 can reach first side 58 and second side 60 of the RMC.

Tool 98 can be used to remove ceramic adhesive 96 before or after core assembly 10 is assembled. Because ceramic cores 12, 14 and 16 are separate elements, each ceramic core and adjoining RMC can be assembled separately. That is, upstream RMC 18 can be secured to leading edge ceramic core 12 with ceramic adhesive 96 apart from the other ceramic cores and RMCs. The ceramic adhesive can be removed by tool 98 before leading edge ceramic core 12 and upstream RMC 18 are aligned with the other cores to form overall core assembly 10. Ceramic adhesive 96 can be removed from both sides of upstream RMC 18 since no obstructions prevent access to first side 58 or second side 60 of upstream RMC 18. FIG. 2A illustrates access paths 99A and 99B from which tool 98 can approach ceramic adhesive 96.

Figure 2B:
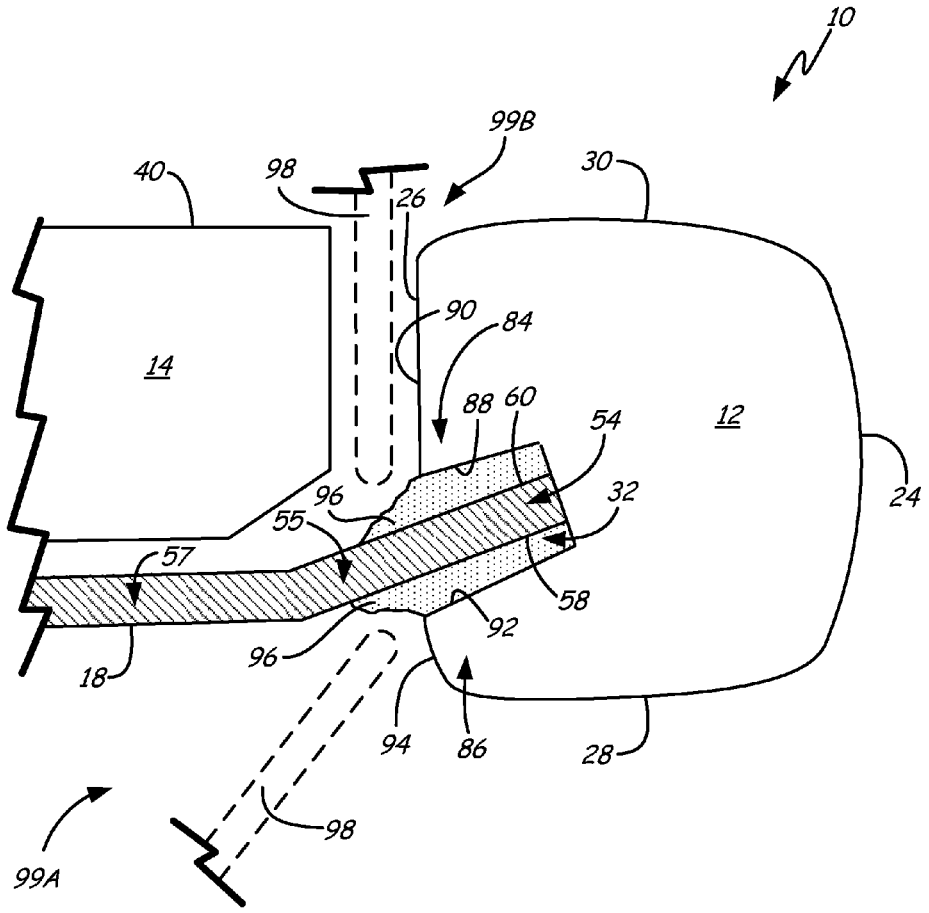
FIG. 2B is another partial cross section view of the core assembly shown in FIG. 1.

Alternatively, ceramic adhesive 96 can be removed by tool 98 after two or more of the various cores of core assembly 10 have been assembled. FIG. 2B illustrates a cross section view of leading edge ceramic core 12, midchord ceramic core 14 and upstream RMC 18 shown in FIG. 1 taken along the line 2-2. While FIG. 2A showed core assembly 10 before all of the ceramic cores were positioned together, FIG. 2B illustrates core assembly 10 after two or more of the ceramic cores have been positioned together. FIG. 2B shows both ceramic core 12 and midchord ceramic core 14. Referring to FIG. 2B, ceramic adhesive 96 can be removed from first side 58 of upstream RMC 18 using tool 98 via access path 99A as no obstructions prevent access to first side 58. The space between leading edge ceramic core 12 and midchord ceramic core 14 creates access path 99B between suction side surface 30 of leading edge ceramic core 12 and suction side surface 40 of midchord ceramic core 14. Access path 99B provides room for tool 98 to be maneuvered between ceramic cores 12 and 14 to remove ceramic adhesive 96 from second side 60 of upstream RMC 18. Additionally, ceramic adhesive 96 can be removed from a single ceramic core of a given configuration with advantageously placed openings and spaces that provide access paths 99.

Figure 2C:
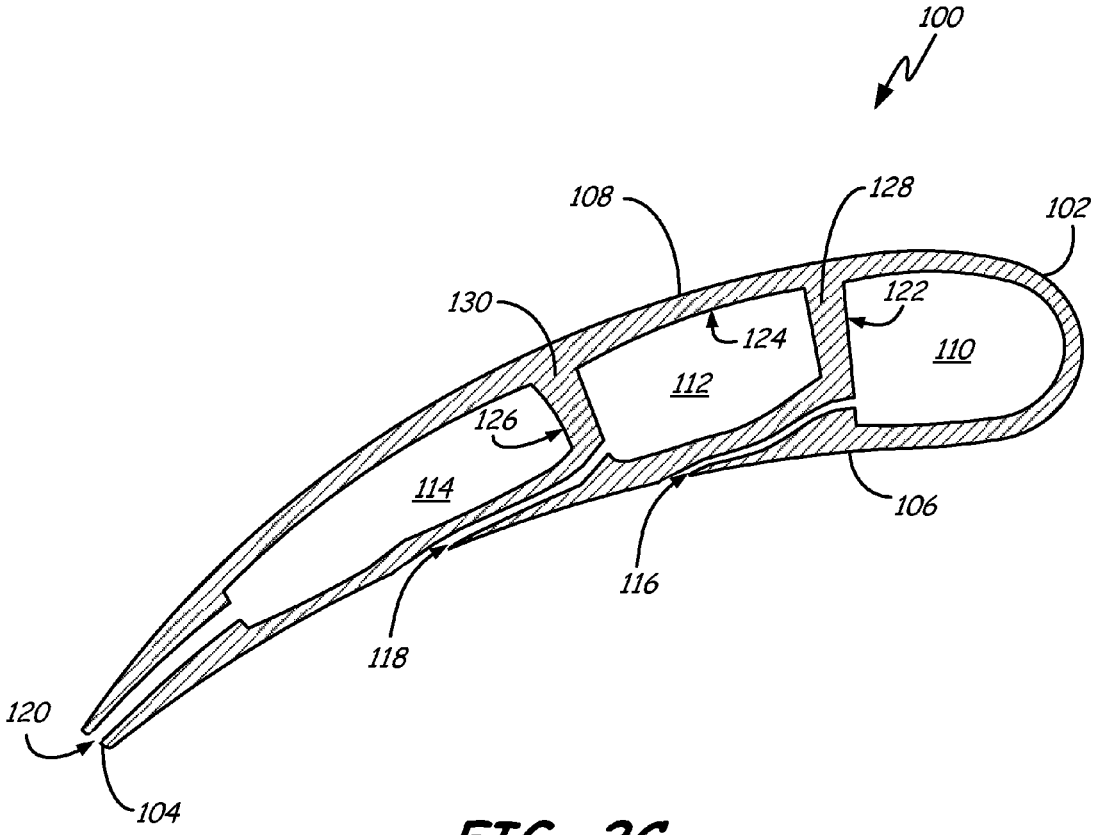
FIG. 2C is a cross section view of an airfoil cast using the core assembly shown in FIG. 1.

FIG. 2C illustrates a cross section view of a finished airfoil cast using core assembly 10 illustrated in FIG. 1. Airfoil 100 includes leading edge surface 102, trailing edge 104, pressure side surface 106, suction side surface 108, leading edge cavity 110, midchord cavity 112, trailing edge cavity 114 and cooling circuits 116, 118 and 120. As a result of the casting process, leading edge cavity 110 is formed by leading edge ceramic core 12, midchord cavity 112 is formed by midchord ceramic core 14 and trailing edge cavity is formed by trailing edge ceramic core 16. Each cavity is bounded by a cavity wall (122, 124 and 126). Rib 128 separates leading edge cavity 110 and midchord cavity 112, and rib 130 separates midchord cavity 112 and trailing edge cavity 114. Cooling circuit 116 is formed by upstream RMC 18, cooling circuit 118 is formed by downstream RMC 20 and cooling circuit 120 is formed by trailing edge RMC 22. As shown in FIG. 2C, cooling circuits 116 and 118 are positioned between a downstream cavity and a side of airfoil 100. For example, cooling circuit 116 joins with leading edge cavity 110 along a downstream portion of cavity wall 122 and extends between midchord cavity 112 and pressure side surface 106. Cooling fluid exits cavity 110 and flows through cooling circuit 116 to cool the pressure side of airfoil 100. Cooling circuit 118 joins with midchord cavity 112 along a downstream portion of cavity wall 124 and extends between trailing edge cavity 114 and pressure side surface 106. Cooling fluid exits cavity 112 and flows through cooling circuit 118 to cool the pressure side of airfoil 100 farther downstream of cooling circuit 116. While FIG. 2C illustrates cooling circuits near the pressure side surface of airfoil 100, cooling circuits can also be located between the cavities and the suction side surface of airfoil 100. Whether ceramic adhesive 96 is removed from the sides of RMC 18 (and RMC 20) as shown in FIG. 2A or FIG. 2B, airfoil 100 will be formed the same, without artifacts in the region where leading edge cavity 110 and cooling circuit 116 meet.

As shown in FIGS. 1, 2A and 2B, the slots on a ceramic core that receive an RMC can be located along a downstream end of the core. Slots 32 and 42 of leading edge ceramic core 12 and midchord ceramic core 14, respectively, are located on respective downstream surfaces 26 and 36. As shown in FIGS. 2A and 2B, lands 86 and 88 both have sides (90, 94) located along downstream surface 26. RMCs 18 and 20 extend from the slot and bend away from the center of the ceramic cores so that they proceed downstream from slots 32 and 42, respectively, and along the sides of the downstream ceramic cores.

Figure 3:
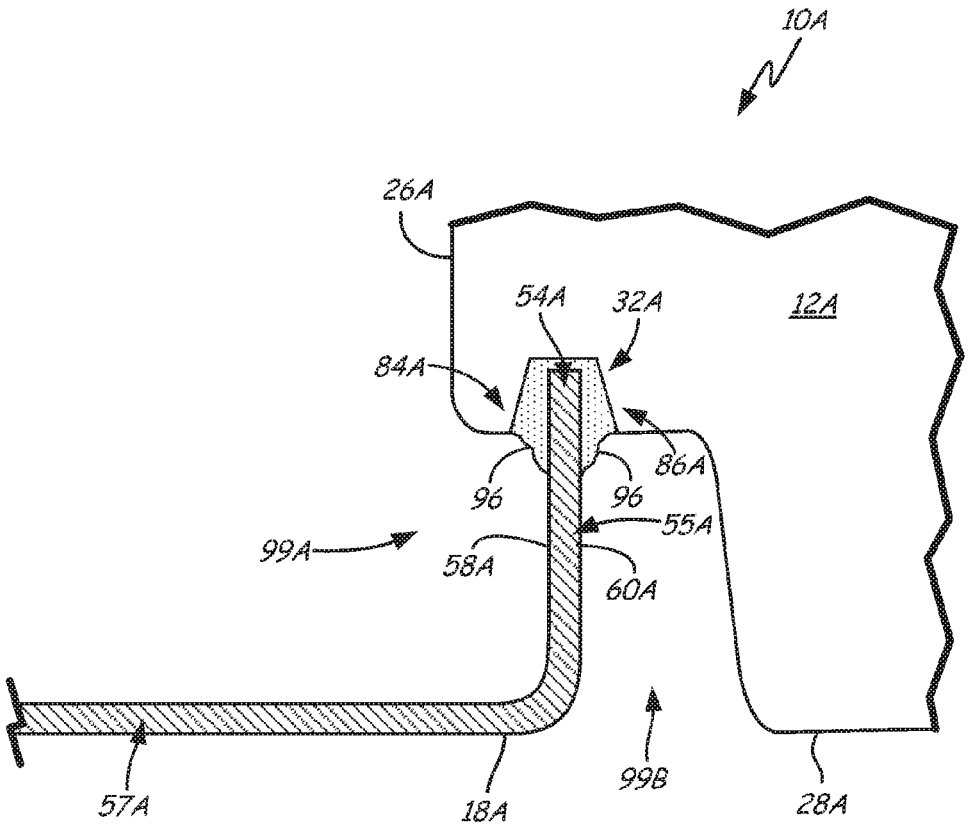
FIG. 3 is a cross section view of one embodiment of a slot in one side of a ceramic core.

The slots that receive an RMC can also be located along the pressure or suction side of a ceramic core. FIG. 3 illustrates one embodiment of a core assembly having a ceramic core with a slot along the pressure side surface of the core. As shown in FIG. 3, core assembly 10A includes only a single core (ceramic core 12A) with downstream surface 26A and pressure side surface 28A. Core assembly 10A also includes upstream RMC 18A. Upstream RMC 18A extends from slots 32A located on pressure side surface 28A of ceramic core 12A. Upstream RMC 18A includes first section 55A located proximate to first end 54A and a portion of first section 55A is located in slot 32A.

Pressure side surface 28A of ceramic core 12A is set back near downstream end 26A and first section 55A of upstream RMC 18A is elongated to provide access paths 99A and 99B to ceramic adhesive 96 on both sides 58A and 60A of upstream RMC 18A before upstream RMC 18A bends. By lengthening first section 55A and setting back slot 32A, enough room is provided between upstream RMC 18A and ceramic core 12A for tool 98 to be used to remove ceramic adhesive 96. In this embodiment, first land 84A and second land 86A are positioned along the pressure side surface of ceramic core 12A. As described above with respect to FIG. 2A, RMC 18A extends from a ceramic core in both a longitudinal direction (second section 57A) and a transverse direction (first section 55A). While the above description has referred to upstream RMC 18A specifically, downstream RMC 20 (pictured in FIG. 1) can be arranged in a similar fashion. The configuration of RMCs and ceramic cores shown in FIG. 3 allows for adhesive removal from both sides of upstream RMC 18A and downstream RMC 20 by creating access paths to both sides of the RMCs.

Figure 4:
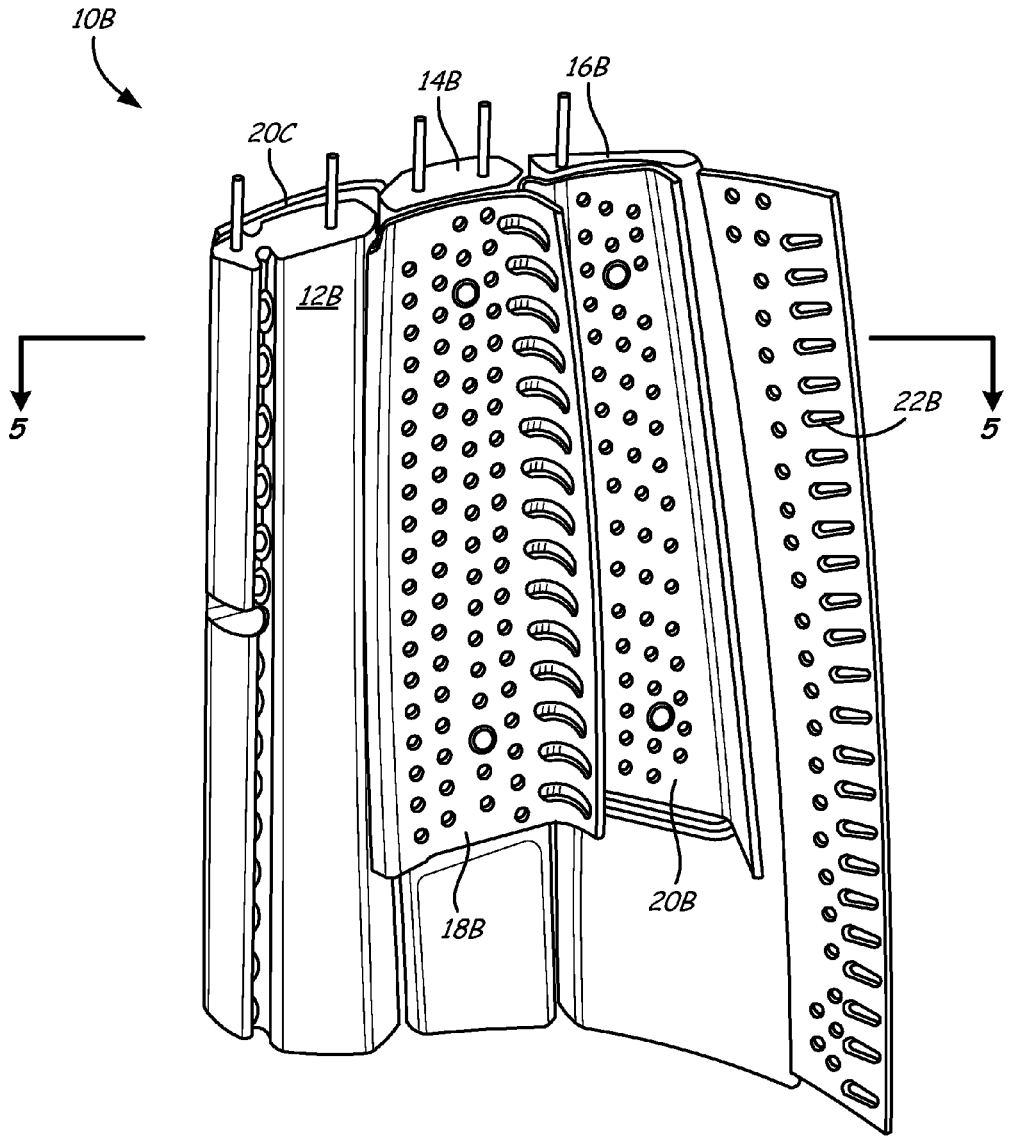
FIG. 4 is a perspective view of another embodiment of a core assembly.
Figure 5A:
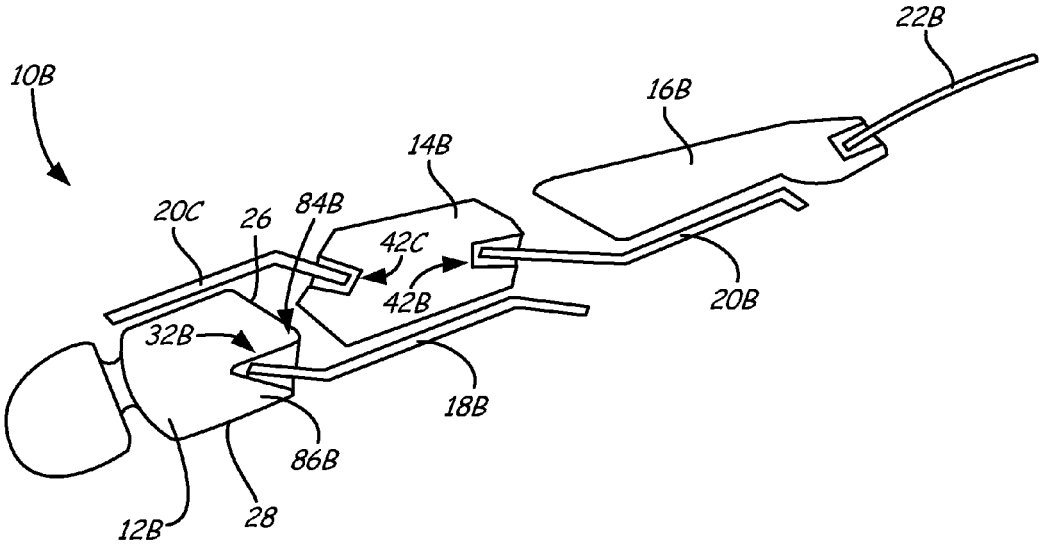
FIG. 5A is a partial cross section view of the core assembly shown in FIG. 3 taken along the line 5-5.
Figure 5B:
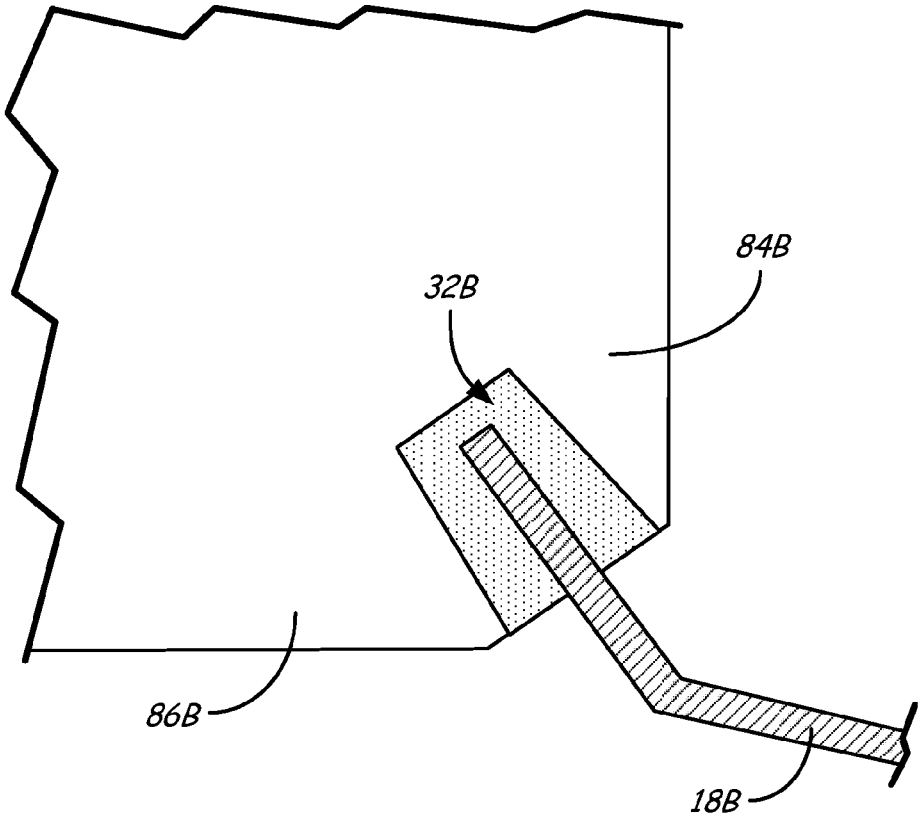
FIG. 5B is an enlarged cross section view of a slot on a chamfered landing.

The slots in the ceramic core that receive the RMC can also be located on a chamfer. FIGS. 4, 5A and 5B illustrate ceramic cores with chamfered landings that contain slots. FIG. 4 illustrates a perspective view of one embodiment of a core assembly. Core assembly 10B includes leading edge ceramic core 12B, midchord ceramic core 14B, trailing edge ceramic core 16B, RMC 18B, RMC 20B, RMC 20C and RMC 22B. FIG. 5A is a cross section view of ceramic core 10B of FIG. 4, taken along the line 5-5. As shown in FIG. 5A, leading edge ceramic core 12B is chamfered between first land 84B and second land 86B. Locating slot 32B on a chamfer can provide improved access to the sides of RMC 18B with tool 98 for adhesive removal. FIG. 5A also illustrates a slot in which one of the lands is on a downstream end of the ceramic core and the other land is on a side (pressure or suction side) of the ceramic core. First land 84B is located along downstream surface 26 while second land 86B is located along pressure side surface 28. FIG. 5B shows an enlarged view of one embodiment of a slot on a chamfered landing with an RMC.

Ceramic cores can contain more than one slot for receiving an RMC. FIGS. 4 and 5A show an embodiment of a core assembly in which two RMCs are secured to a single ceramic core. RMC 20B and RMC 20C are both secured to midchord ceramic core 14B. RMC 20B extends from slot 42B in a generally downstream direction while RMC 20C extends from slot 42C in a generally upstream direction. Given the arrangement of ceramic cores and RMCs as shown in FIGS. 4 and 5A, the ceramic adhesive is removed from the inner side of RMC 20C before core assembly 10B is fully assembled as no paths allow tool access to that side of the RMC once ceramic cores 12B and 14B are positioned.

FIGS. 1, 4 and 5A also illustrate overlapping RMCs. As shown in FIG. 1, second end 56 of upstream RMC 18 extends downstream farther than first end 64 of downstream RMC 20. In FIGS. 4 and 5A RMC 18B and RMC 20B also overlap. By overlapping RMCs 18 and 20, subsequent casting produces an airfoil having overlapping cooling circuits, in this case within the pressure side wall.

Figure 6:
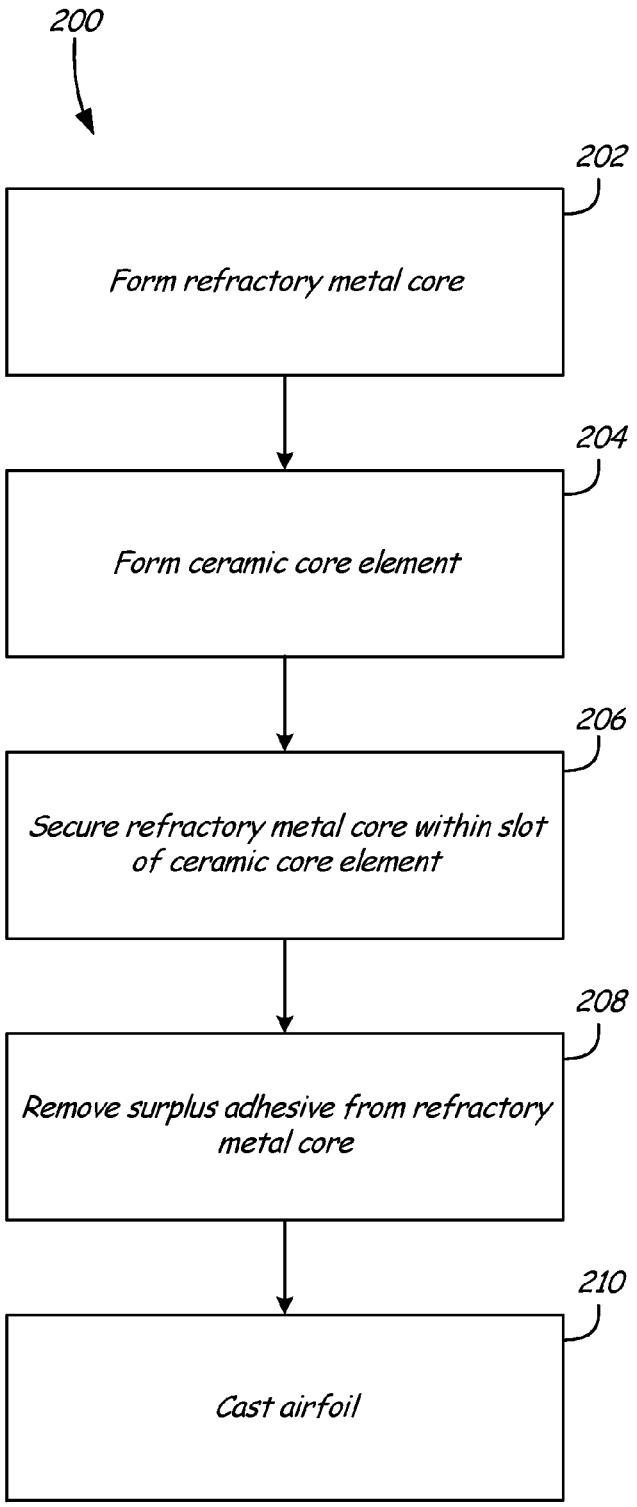
FIG. 6 is a simplified flow diagram illustrating one embodiment of a method for forming an airfoil.

Core assemblies 10 can be used to form airfoils with cooling circuits using die or investment casting techniques. FIG. 6 illustrates a simplified flow diagram of one embodiment of an investment casting method (method 200) for forming an airfoil. A refractory metal core (RMC) is formed and coated in step 202. The RMC includes first and second ends and first and second sides, each side extending from the first end to the second end. A ceramic core element is formed in step 204. The ceramic core element includes a slot positioned between first and second lands. In step 206, the first end of the RMC is secured into the slot of the ceramic core element with an adhesive. The slot, first and second lands of the ceramic core element and the first end and first and second sides of the RMC form a core assembly that provides access paths to the first and second sides of the RMC near the first end. Surplus adhesive is removed from the first and second sides of the RMC near the first end with a tool via the access paths in step 208. Investment casting processes are then applied in step 210 to form the airfoil. The core assembly is fully assembled prior to casting. Depending on the configuration of the ceramic core elements and the RMCs, the assembly can take place between steps 206 and 208 or steps 208 and 210. In embodiments like those shown in FIG. 1, access paths 99 are present between adjacent ceramic cores allowing adhesive removal after the core is assembled. In embodiments like those shown in FIG. 3, adhesive is removed prior to full assembly of the core assembly.

During step 210, a wax pattern is formed over the core assembly. A ceramic shell is then formed over the wax pattern and the wax pattern is removed from the shell. Molten metal is introduced into the ceramic shell. The molten metal, upon cooling, solidifies and forms the walls of the airfoil. The ceramic core element forms inner passages within the airfoil and the RMC forms the profile of a cooling circuit within the wall of the airfoil. The ceramic shell is removed from the cast part. Thereafter, the ceramic feed core and the RMC are removed, typically chemically, using a suitable removal technique. Removal of the RMC provides an airfoil with a cooling circuit within the airfoil wall. Because the adhesive was able to be removed from the first and second sides of the RMC, the cooling circuit can be cast without unwanted artifacts.

The following are non-exclusive descriptions of possible embodiments.

A method for casting a component can include forming a refractory metal core, forming a ceramic core element, securing a first end of the refractory metal core into a slot of the ceramic core with an adhesive to form a core assembly, removing surplus adhesive from the refractory metal core and investment casting the airfoil using the core assembly. The refractory metal core can include first and second ends and first and second sides, each side extending from the first end to the second end. The ceramic core element can include an upstream end, a downstream end, a first side extending from the upstream end to the downstream end, a second side extending from the upstream end to the downstream end and generally opposite the first and a slot positioned between a first land and a second land for receiving the first end of the refractory metal core. Each land can include an inner surface facing the slot and an outer surface adjacent the inner surface. The refractory metal core can extend from the ceramic core element in both a longitudinal and a transverse direction. The slot and the first and second lands of the ceramic core element and the first end and the first and second sides of the refractory metal core can form a core assembly that provides access paths to the first and second sides of the refractory metal core near the first end. Surplus adhesive can be removed from the first and second sides of the refractory metal core near the first end of the refractory metal core with a tool via the access paths. Investment casting can provide the component with an internal core passage and an internal cooling circuit.

The method of the preceding paragraph can optionally include, additionally and/or alternatively, any one or more of the following features, configurations and/or additional components:

In a further embodiment of the foregoing method, the component can be an airfoil.

In a further embodiment of any of the foregoing methods, at least one of the first and second lands can be located on the downstream end of the ceramic core element.

In a further embodiment of any of the foregoing methods, at least one of the first and second lands can be located on the upstream end of the ceramic core element.

In a further embodiment of any of the foregoing methods, at least one of the first and second lands can be located on one of the sides of the ceramic core element.

In a further embodiment of any of the foregoing methods, the ceramic core element can further include a chamfer between the first and second lands.

In a further embodiment of any of the foregoing methods, the refractory metal core can further include a first section proximate to the first end and a second section located between the first section and the second end, where the second section is angled relative the first section.

In a further embodiment of any of the foregoing methods, the angle between the first and second sections can be at least about 90°.

In a further embodiment of any of the foregoing methods, the method can further include 1) forming a second core assembly having a second refractory metal core with first and second ends and first and second sides, each side extending from the first end to the second end and a second ceramic core element having a second slot positioned between a first land and a second land of the second ceramic core element where the second refractory metal core is secured within the slot of the second ceramic core element with an adhesive, 2) removing substantially all surplus adhesive from the first and second sides of the second refractory metal core near the first end and 3) positioning the first and second core assemblies together prior to casting so that investment casting provides the component with two internal core passages and two internal cooling circuits.

In a further embodiment of any of the foregoing methods, the first and second core assemblies can be positioned so that a portion of the first refractory metal core overlaps with a portion of the second refractory metal core.

In a further embodiment of any of the foregoing methods, the steps of removing surplus adhesive from the sides of the refractory metal core and the second refractory metal core can occur prior to positioning the first and second core assemblies together.

In a further embodiment of any of the foregoing methods, the steps of removing surplus adhesive from the sides of the refractory metal core and the second refractory metal core can occur after positioning the first and second core assemblies together.

A core assembly can include a ceramic core element, a refractory metal core and an adhesive. The ceramic core element can include an upstream end, a downstream end, a first side extending from the upstream end to the downstream end, a second side extending from the upstream end to the downstream end and generally opposite the first and a slot formed between a first land and a second land. Each land can have an inner surface facing the slot and an outer surface adjacent the inner surface. The refractory metal core can include first and second ends, a first side extending from the first end to the second end and a second side extending from the first end to the second end. The refractory metal core can extend from the ceramic core element in both a longitudinal and a transverse direction. The first end can be secured within the slot of the ceramic core element with the adhesive so that the first side of the refractory metal core and the first land form a first access path to the adhesive and the second side of the refractory metal core and the second land form a second access path to the adhesive. The first and second access paths can allow adhesive removal from the first and second sides of the refractory metal core.

The assembly of the preceding paragraph can optionally include, additionally and/or alternatively, any one or more of the following features, configurations and/or additional components:

In a further embodiment of the foregoing assembly, at least one of the first and second lands can be located on the downstream end of the ceramic core element.

In a further embodiment of any of the foregoing assemblies, at least one of the first and second lands can be located on the upstream end of the ceramic core element.

In a further embodiment of any of the foregoing assemblies, at least one of the first and second lands can be located on one of the sides of the ceramic core element.

In a further embodiment of any of the foregoing assemblies, the ceramic core element can further include a chamfer between the first and second lands.

In a further embodiment of any of the foregoing assemblies, the slot can be located on a set back portion of the ceramic core element.

In a further embodiment of any of the foregoing assemblies, the core assembly can further include 1) a second ceramic core element having a slot formed between a first land and a second land, each land having an inner surface facing the slot and an outer surface adjacent the inner surface and 2) a second refractory metal core having first and second ends, a first side extending from the first end to the second end and a second side extending from the first end to the second end where the first end of the second refractory metal core is secured within the slot of the second ceramic core element with an adhesive such that the first side of the second refractory metal core and the first land form a first access path to the adhesive and the second side of the refractory metal core and the second land form a second access path to the adhesive, the first and second access paths allowing adhesive removal from the first and second sides of the refractory metal core.

In a further embodiment of any of the foregoing assemblies, the first and second ceramic core elements can be positioned so that a portion of the first refractory metal core overlaps with a portion of the second refractory metal core.

In a further embodiment of any of the foregoing assemblies, the ceramic core element can further include 1) a second slot formed between a third land and a fourth land, each land having an inner surface facing the second slot and an outer surface generally opposite the second slot and 2) a second refractory metal core having first and second ends, a first side extending from the first end to the second end and a second side extending from the first end to the second end where the first end of the second refractory metal core is secured within the second slot of the ceramic core element with an adhesive such that the first side of the second refractory metal core and the third land form a first access path to the adhesive and the second side of the refractory metal core and the fourth land form a second access path to the adhesive, the first and second access paths allowing adhesive removal from the first and second sides of the refractory metal core.

In a further embodiment of any of the foregoing assemblies, the adhesive used to secure the refractory metal core to the ceramic core element can be a ceramic adhesive.

In a further embodiment of any of the foregoing assemblies, the core assembly can be substantially free of adhesive outside of the slot.

A cast component can include a leading edge surface, a trailing edge surface, a pressure side surface extending from the leading edge surface to the trailing edge surface, a suction side surface extending from the leading edge surface to the trailing edge surface generally opposite the pressure side surface, a first feed cavity, a second feed cavity, a rib separating the first and second feed cavities and a cooling passage. The first feed cavity can be located between the leading edge and trailing edge surfaces and between the pressure side and suction side surfaces and bounded by a first cavity wall. The second feed cavity can be located between the first feed cavity and the trailing edge surface and between the pressure side and suction side surfaces and bounded by a second cavity wall. The cooling passage can be in communication with the first feed cavity and can extend between the second feed cavity and either the pressure side surface or the suction side surface.

The component of the preceding paragraph can optionally include, additionally and/or alternatively, any one or more of the following features, configurations and/or additional components:

In a further embodiment of the foregoing component, the cooling passage can join the first feed cavity along a downstream portion of the first cavity wall.

In a further embodiment of any of the foregoing assemblies, the cooling passage can join the first feed cavity along an upstream portion of the first cavity wall.

In a further embodiment of any of the foregoing assemblies, the cooling passage can join the first feed cavity along a side portion of the first cavity wall.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A core assembly comprising:

a ceramic core element comprising:

an upstream end;

a downstream end;

a first side extending from the upstream end to the downstream end;

a second side extending from the upstream end to the downstream end and generally opposite the first; and a slot formed between a first land and a second land, each land having an inner surface facing the slot and an outer surface adjacent the inner surface;

a refractory metal core comprising:

first and second ends;

a first side extending from the first end to the second end; and a second side opposite the first side and extending from the first end to the second end; and an adhesive, wherein the first end of the refractory metal core is secured within the slot of the ceramic core element with the adhesive such that the first end of the refractory metal core extends from the ceramic core element in both a longitudinal and a transverse direction;

a first access path to the adhesive formed between the first side of the refractory metal core and the first land, wherein the first access path allows adhesive removal from the first side of the refractory metal core; and a second access path to the adhesive formed between the second side of the refractory metal core and the second land, wherein the second access path allows adhesive removal from the second side of the refractory metal core.

2. The core assembly of claim 1, wherein at least one of the first and second lands is located on the downstream end of the ceramic core element.

3. The core assembly of claim 1, wherein at least one of the first and second lands is located on the upstream end of the ceramic core element.

4. The core assembly of claim 1, wherein at least one of the first and second lands is located on one of the sides of the ceramic core element.

5. The core assembly of claim 1, wherein the ceramic core element further comprises a chamfer between the first and second lands.

6. The core assembly of claim 1, wherein the slot is located on a set back portion of the ceramic core element.

7. The core assembly of claim 1, further comprising:

a second ceramic core element comprising:

a slot formed between a first land and a second land, each land having an inner surface facing the slot and an outer surface adjacent the inner surface; and a second refractory metal core comprising:

first and second ends;

a first side extending from the first end to the second end; and a second side extending from the first end to the second end, wherein the first end of the second refractory metal core is secured within the slot of the second ceramic core element with an adhesive such that the first side of the second refractory metal core and the first land form a first access path to the adhesive and the second side of the refractory metal core and the second land form a second access path to the adhesive, the first and second access paths allowing adhesive removal from the first and second sides of the refractory metal core.

8. The core assembly of claim 7, wherein the first and second ceramic core elements are positioned so that a portion of the first refractory metal core overlaps with a portion of the second refractory metal core.

9. The core assembly of claim 1, wherein the ceramic core element further comprises:

a second slot formed between a third land and a fourth land, each land having an inner surface facing the second slot and an outer surface generally opposite the second slot; and a second refractory metal core comprising:

first and second ends;

a first side extending from the first end to the second end; and a second side extending from the first end to the second end, wherein the first end of the second refractory metal core is secured within the second slot of the ceramic core element with an adhesive such that the first side of the second refractory metal core and the third land form a first access path to the adhesive and the second side of the refractory metal core and the fourth land form a second access path to the adhesive, the first and second access paths allowing adhesive removal from the first and second sides of the refractory metal core.

10. The core assembly of claim 1, wherein the adhesive used to secure the refractory metal core to the ceramic core element is a ceramic adhesive.

11. The core assembly of claim 1, wherein the core assembly is substantially free of adhesive outside of the slot.

12. A core assembly comprising:

a ceramic core element comprising:

an upstream end;

a downstream end;

a first side extending from the upstream end to the downstream end;

a second side extending from the upstream end to the downstream end and generally opposite the first; and a slot formed between a first land and a second land, each land having an inner surface facing the slot and an outer surface adjacent the inner surface;

a refractory metal core comprising:

first and second ends;

a first side extending from the first end to the second end; and a second side opposite the first side and extending from the first end to the second end;

an adhesive, wherein the first end of the refractory metal core is secured within the slot of the ceramic core element with the adhesive such that the first end of the refractory metal core extends from the ceramic core element;

a first access path to the adhesive formed between the first side of the refractory metal core and the first land, wherein the first access path allows adhesive removal from the first side of the refractory metal core; and a second access path to the adhesive formed between the second side of the refractory metal core and the second land, wherein the second access path allows adhesive removal from the second side of the refractory metal core.

13. The core assembly of claim 12, wherein the refractory metal core further comprises:

a first section proximate to the first end; and a second section located between the first section and the second end, wherein the second section is angled relative the first section and the angle between the first and second sections is at least about 90°.

* * * * *